US006413030B1

(12) United States Patent
Jones et al.

(10) Patent No.: US 6,413,030 B1
(45) Date of Patent: Jul. 2, 2002

(54) STOP BAR FOR REAR HOPPER REFUSE COLLECTION VEHICLES

(75) Inventors: Gary A. Jones; James C. White, both of Oshkosh; John A. Zaborsky, Neenah, all of WI (US)

(73) Assignee: Leach Company, Oshkosh, WI (US)

( * ) Notice: Subject to any disclaimer, the term of this patent is extended or adjusted under 35 U.S.C. 154(b) by 0 days.

(21) Appl. No.: 09/824,121

(22) Filed: Apr. 2, 2001

(51) Int. Cl.[7] ..... B65F 3/04
(52) U.S. Cl. ..... 414/406; 414/408
(58) Field of Search ..... 414/406, 408

(56) References Cited

FOREIGN PATENT DOCUMENTS

| | | | |
|---|---|---|---|
| AT | 243183 | * 10/1965 | ..... 414/408 |
| GB | 2078196 | * 1/1982 | ..... 414/408 |

* cited by examiner

*Primary Examiner*—Steven A. Bratlie
(74) *Attorney, Agent, or Firm*—Cook, Alex, McFarron, Manzo, Cummings & Mehler, Ltd.

(57) ABSTRACT

A stop bar for use in a refuse collection vehicle with a rear hopper having an opening defined by sidewalls, an upper edge, and a loading sill. The stop bar includes an elongated bar with support arms secured to each of its ends. The support arms are pivotally mounted to the sidewalls of the hopper and two stops are provided for limiting the pivoting movement of the stop bar between a first, non-engaged position and a second, fully engaged position.

16 Claims, 3 Drawing Sheets

STOP BAR FOR REAR HOPPER REFUSE COLLECTION VEHICLES

BACKGROUND OF THE INVENTION

The present invention relates to refuse collection vehicles and, more particularly, to rear hopper refuse collection vehicles.

Rear hopper refuse collection trucks are designed to handle large, wheeled refuse containers, typically having capacities of 2, 3, 4, 6, 8 and 10 cubic yards. These refuse containers are formed with a trunnion along one side of their open upper ends, and are secured to the rear of the truck adjacent the loading sill of the hopper. They are pivoted about their trunnions by, e.g., a push bar (for containers of up to 4 cubic yard capacity) and a winch having a cable and hook or a hydraulic cylinder (known as a reeving cylinder) (for containers of 5 cubic yard capacity or more) in order to tip the containers and discharge their contents into the hopper.

The container must be pivoted about the trunnion a sufficient amount so that the refuse contained therein will slide out, but not so far that the center of gravity of the container passes over the pivot axis defined by the trunnion, in which case the container would continue to rotate about the trunnion and either fall into the hopper or hit and damage the top edge of the hopper opening.

Efforts to prevent the container from being "over-tipped" are complicated by the shifting center of gravity as the container empties, and by the various sizes for the different containers that are emptied during a typical garage pick-up route.

In view of the above, the hoppers of some refuse collection trucks have been provided with a stop in a form of a beam that spans the hopper opening near the top of the opening. The beam is rigidly affixed to the side walls of the hopper and serves as a guard to prevent an "over-tipped" container from hitting and damaging the hopper opening. Such a fixed stop bar works well with standard-size containers, but may not be effective for other sizes or shapes for containers. Also, while the fixed stop bar protects the hopper opening from damage due to "overtipped" containers, the stop bar instead can become damaged.

Accordingly, it is an object of the present invention to provide a rear hopper refuse collection vehicle with some means for preventing over-tipping of refuse containers and the damage to the hopper caused thereby.

It is a further object to provide a stop bar that permits a greater tip angle than is obtainable with conventional, stationary stop bars, thereby providing more efficient discharge of refuse into the vehicle hopper.

More particularly, it is an object of the present invention to provide an improved stop bar for securing to the hopper.

It is a further object to provide an improved stop bar that works effectively with refuse containers of various sizes and shapes.

It is an additional object to provide an improved stop bar that is less susceptible to damage resulting from the performance of its intended functions.

SUMMARY OF THE INVENTION

These objects, as well as others that will become apparent upon reference to the following detailed description and the accompanying drawings, are achieved by a stop bar for use in a refuse collection vehicle with a rear hopper having an opening defined by sidewalls, an upper edge, and a loading sill. The stop bar includes an elongated bar with support arms secured to each of its ends. The support arms are pivotally mounted to the sidewalls of the hopper. Two stops are provided for limiting the pivoting movement of the stop bar between a first, non-engaged position and a second, fully engaged position. These stops engage at least one, and preferably both of the support arms. In the preferred embodiment, each support arm is pivotally mounted to a bracket secured to the hopper sidewall. Both the bracket and the support arm include a flange, with each flange supporting one of the stops. The stop bar may advantageously include a spring to cushion the impact of a refuse container as the stop bar moves from its first position to the second position, and also to bias the stop bar toward its first position.

DETAILED DESCRIPTION OF THE PREFERRED EMBODIMENTS

Figure 1:
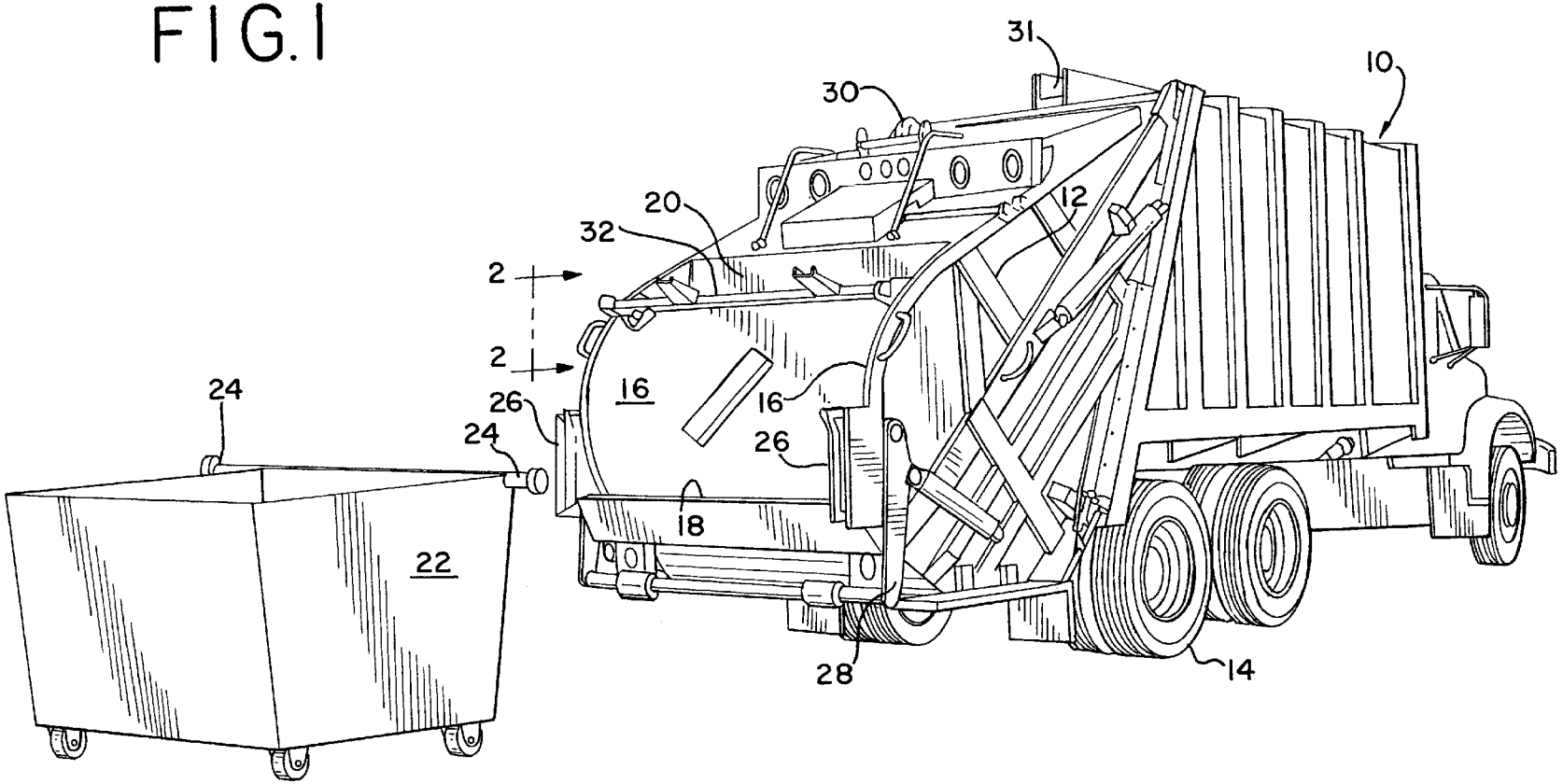
FIG. 1 is a perspective view of a rear hopper refuse collection truck and a refuse container.

Turning to the figures of the drawings, there is seen in FIG. 1 a perspective view of a rear hopper refuse collection truck, generally indicated by 10, with which a stop bar according to the present invention may be advantageously used. The truck 10 includes a hopper portion 12 depending from the truck generally rearward of the rear wheels 14 into which refuse is dumped for compaction. The hopper 12 includes a rearward-facing opening generally defined by the sidewalls 16 of the hopper 12, a lower loading edge or sill 18, and an upper edge 20.

Also, shown in FIG. 1 is a rollable refuse container 22 having an open upper end including, on one side, a trunnion bar 24 that extends beyond the edges of the container 22. As is well known, to empty the container 22 of its contents, the container 22 is positioned with the trunnion bar 24 adjacent the loading edge 18 of the hopper 12. The trunnion bar 24 is then secured to the truck 10 by various well-known means, such as pivotable locking latches 26. The container 22 is then pivoted about the trunnion 24 by means of, e.g., an hydraulically actuated push bar 28, a drum winch 30 having a cable and hook (not shown), or a hydraulic cylinder 31.

In keeping with the invention, the hopper 12 is provided with a stop bar, generally designated 32, that spans the opening in the hopper 12 adjacent the upper edge 20. The stop bar 32 is located so that it permits the container 22 to tip a sufficient amount to allow its contents to be discharged without the stop bar 32 interfering with the movement of the refuse into the hopper 12.

The stop bar 32 is made of an elongated section of square steel tubing 34 that has a support arm 36 secured to each end by, e.g., welding. Each support arm 36 includes a pivot mount 37 that secures the support arm 36 to a mounting bracket 38 secured to the sidewalls 16 of the hopper by, e.g., bolts 39.

Figure 2:
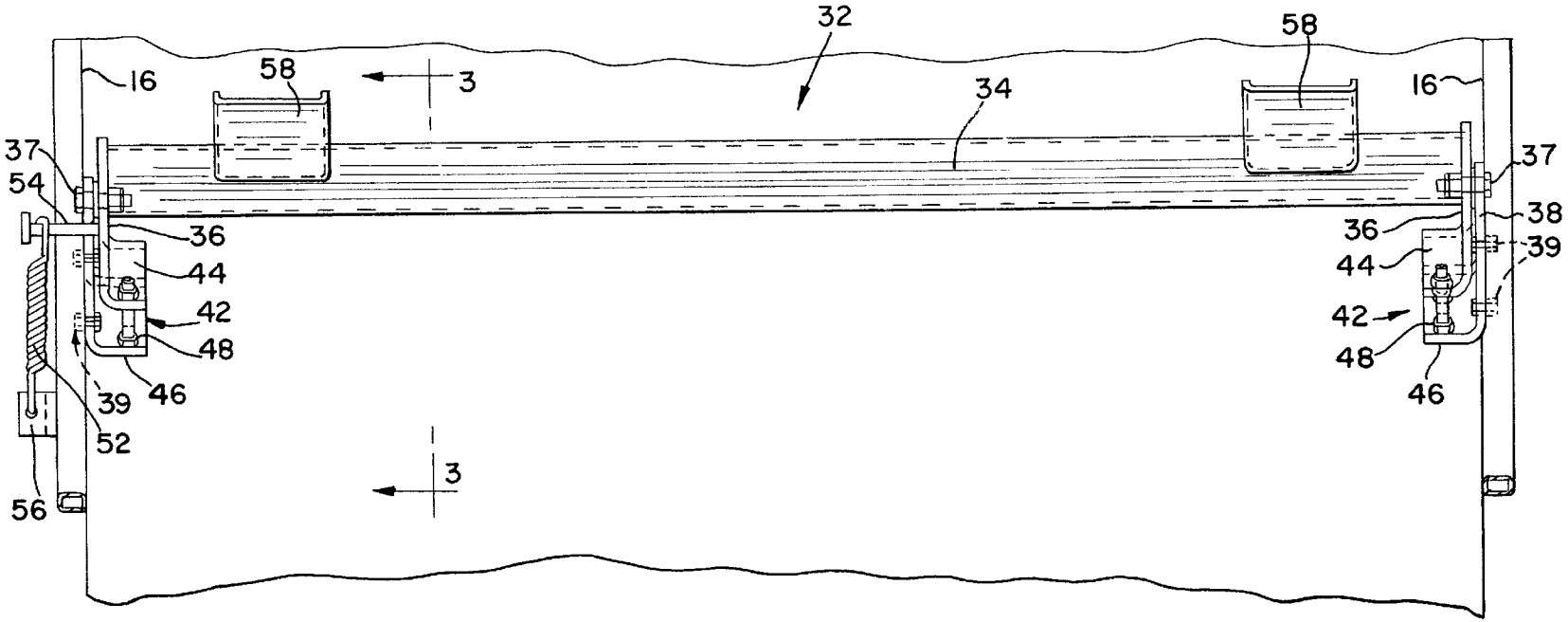
FIG. 2 is a fragmentary plan view of a stop bar pursuant to the present invention taken along line 2—2 of FIG. 1.
Figure 3:
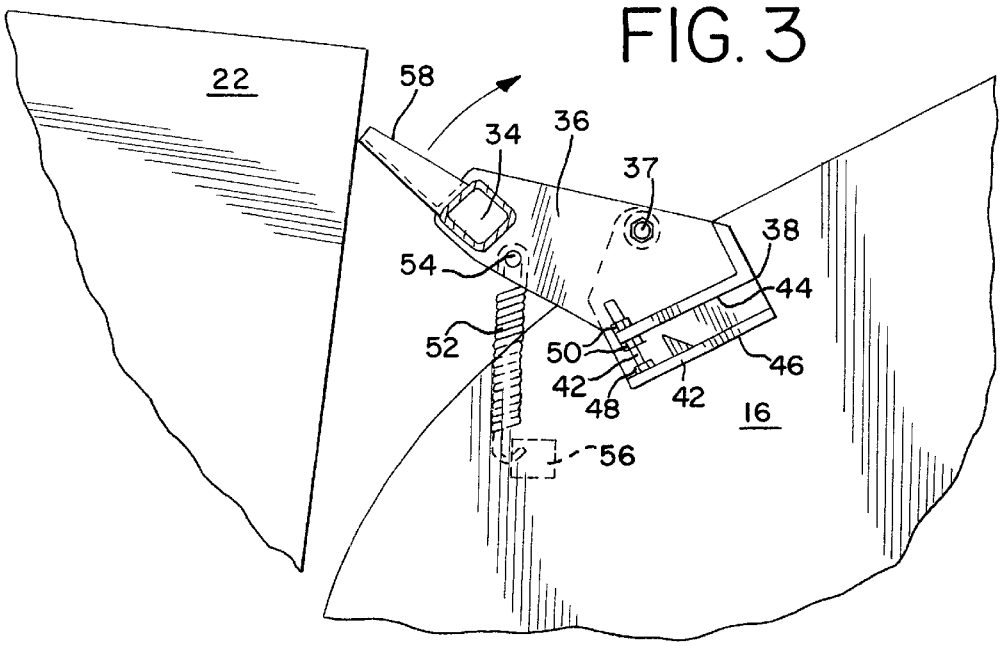
FIG. 3 is a side view, impartial cross section, taken along line 3—3 of FIG. 2 showing the stop bar in its initial position when first engaged by a container.
Figure 4:
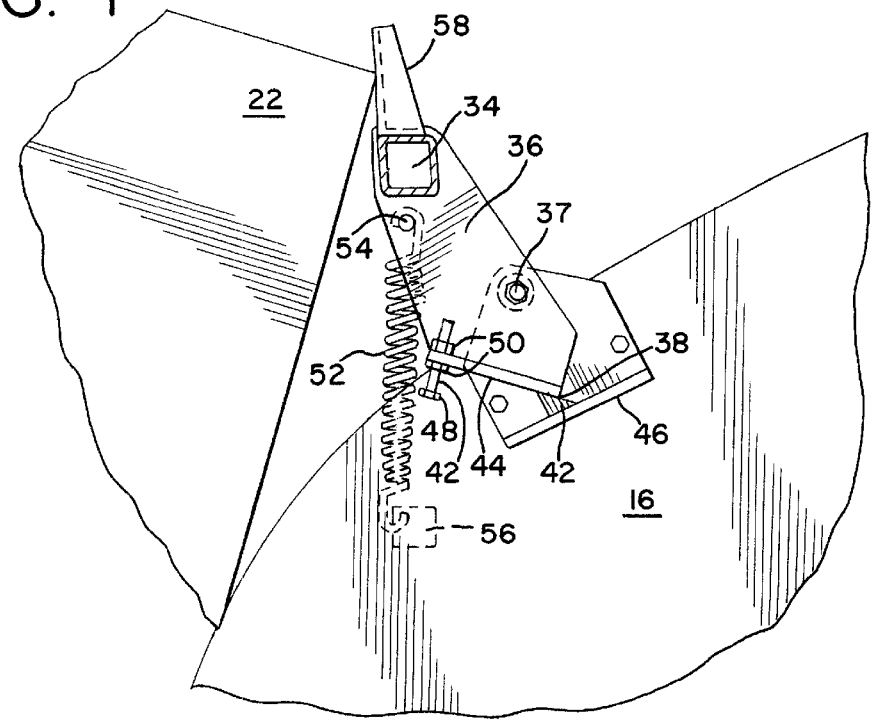
FIG. 4 is a side view similar to FIG. 3 showing the stop bar pivoted to its second position.

In keeping with one aspect of the invention, the stop bar 32 is provided means that limit the pivotal motion of the stop bar 32 when engaged by a tipped container between a first, non-engaged position (FIG. 3) to a second, engaged position (FIG. 4). To this end, the stop bar 32 is provided with a pair of motion-limiting stops. With reference to FIGS. 2–4, at least one (and preferably both) of the support arms 36 have stops 40 and 42 associated therewith. The stops 40, 42 limit the pivotal motion of the support arms by limiting the extent of rotation of the support arms 36 with respect to their mounting brackets 38.

In the illustrated embodiment, both the support arm 36 and its associated mounting bracketing 38 are formed with a generally perpendicularly-oriented flange 44 and 46, respectively. Each one of the flanges 44, 46 support one of the stop members 40, 42, with the other of the flanges engaging one of the stops at the first and second positions of the stop bar 32. Specifically, stop 40 comprises a length of triangular bar stock welded to the flange 46 so that the hypotenuse forms an abutment surface that engages the flange 44 on the support arm 36 when the stop bar 32 is pivoted to its second position (FIG. 4). Stop 42 is secured to the flange 44 on the support arm 36 and comprises a threaded bolt 48 received in a through-hole in the flange 44. The head of the bolt 48 abuts the flange 46 on the mounting bracket 38 when the support arm is in the first position (FIG. 3). The bolt 48 may be secured to the flange by a pair of nuts 50, one nut 50 being on the shaft of the bolt 48 on either side of the flange 44. As can be appreciated, this configuration allows for the nuts 50 to be moved along the threaded shaft of the bolt 48 to provide for some limited adjustment of the first position of the stop bar 32.

The stop bar 32 may be mounted to the truck 10 so that gravity urges the stop bar 32 to the position of FIG. 3. Alternatively, or additionally, the stop bar assembly 32 may include at least one spring 52 to bias the stop arm 32 towards its first position. The spring 52 also opposes the movement of the stop bar towards its second position, thus providing some cushioning when the stop bar 32 is engaged by a tipped container 22. As illustrated, one end of the spring 52 is secured to a bracket 54 affixed to the support arm 36, and the other end is secured to a bracket 56 affixed to the hopper sidewalls 16.

In keeping with a further aspect of the invention, the stop bar 32 maybe provided with one or more projecting ears 58 secured to the stop bar 32 intermediate the two ends of the tube member 34. These ears 58, which may be secured to the tube 34 by welding, provide additional support surfaces for engagement with containers of various sizes and configurations.

Thus, an improved stop bar for a refuse collection vehicle has been provided that meets all the objects of the present invention. While the invention has been described in terms of a preferred embodiment, there is no intent to limited to the same. Instead, the invention is intended to be defined by the appended claims.

What is claimed is:

1. In a refuse collection vehicle having a rear hopper with an opening defined by sidewalls, an upper edge, and a loading sill, a stop bar assembly comprising:

an elongated bar having first and second ends;

first and second support arms secured to the first and second ends, respectively, of the elongated bar, the first and second support arms being pivotally mounted to the sidewalls of the hopper; and first and second stops for limiting pivot motion of the stop bar between a first, non-engaged position and a second, fully engaged position.

2. The stop bar assembly of claim 1, in which the first and second stops engage at least one of the support arms.

3. The stop bar assembly of claim 1, in which each support arm has a first and second stop associated therewith.

4. The stop bar assembly of claim 1, in which each support arm is pivotally mounted to a bracket secured to the hopper sidewall.

5. The stop bar assembly of claim 4, wherein the bracket comprises a flange, the flange supporting at least one of the first and second stops.

6. The stop bar assembly of claim 1, wherein each support arm includes a flange, the flange supporting at least one of the first and second stops.

7. The stop bar assembly of claim 1, wherein the elongated bar includes at least one ear intermittent of its first and second ends.

8. The stop bar assembly of claim 1, further including a spring to resist movement from the first position to the second position and to urge the stop bar towards the first position.

9. A refuse collection vehicle comprising:

a rear hopper with an opening defined by sidewalls, an upper edge, and a loading sill; and a stop bar assembly comprising an elongated bar having first and second ends, first and second support arms secured to the first and second ends, respectively, of the elongated bar, the first and second support arms being pivotally mounted to the sidewalls of the hopper, and first and second stops for limiting pivot motion of the stop bar between a first, non-engaged position and a second, fully engaged position.

10. The refuse collection vehicle of claim 9, in which the first and second stops of the stop bar assembly engage at least one of the support arms.

11. The refuse collection vehicle of claim 9, in which each support arm of the stop bar assembly has a first and second stop associated therewith.

12. The refuse collection vehicle of claim 9, in which each support arm of the stop bar assembly is pivotally mounted to a bracket secured to the hopper sidewall.

13. The refuse collection vehicle of claim 12, wherein the bracket of the stop bar assembly comprises a flange, the flange supporting at least one of the first and second stops.

14. The refuse collection vehicle of claim 9, wherein each support arm of the stop bar assembly includes a flange, the flange supporting at least one of the first and second stops.

15. The refuse collection vehicle of claim 9, wherein the elongated bar of the stop bar assembly includes at least one ear intermittent its first and second ends.

16. The refuse collection vehicle of claim 9, wherein the stop bar assembly further comprises a spring to resist movement from the first position to the second position and to urge the stop bar towards the first position.

* * * * *